US007216868B2

(12) United States Patent
Groz et al.

(10) Patent No.: US 7,216,868 B2
(45) Date of Patent: May 15, 2007

(54) WORD FORMING BOARD GAME WITH LETTERED TILES

(76) Inventors: John C. Groz, 3 Carmona Way, Kissimmee, FL (US) 34758; Robert Groz, 97 Fowler Rd., Lowell, MA (US) 01854

( * ) Notice: Subject to any disclaimer, the term of this patent is extended or adjusted under 35 U.S.C. 154(b) by 0 days.

(21) Appl. No.: 11/347,104

(22) Filed: Feb. 3, 2006

(65) Prior Publication Data

US 2006/0175757 A1 Aug. 10, 2006

Related U.S. Application Data

(60) Provisional application No. 60/650,810, filed on Feb. 8, 2005.

(51) Int. Cl.
*A63F 3/00* (2006.01)

(52) U.S. Cl. ..... 273/272; 273/299

(58) Field of Classification Search ..... 273/242, 273/272, 281, 299; 434/167, 171, 172, 177
See application file for complete search history.

(56) References Cited

U.S. PATENT DOCUMENTS 3,396,972 A * 8/1968 Smith ..... 273/272
4,244,580 A 1/1981 Hoyles
4,819,945 A * 4/1989 Porcheddu ..... 273/272
5,374,065 A 12/1994 Motskin
6,460,854 B1 * 10/2002 McCarey ..... 273/272
6,508,468 B1 * 1/2003 Challice ..... 273/272
7,044,467 B1 * 5/2006 Dimmig ..... 273/272

FOREIGN PATENT DOCUMENTS

GB 2117255 2/1983
GB 2319881 3/1998

* cited by examiner

*Primary Examiner*—William M. Pierce
(74) *Attorney, Agent, or Firm*—James Ray & Assoc.

(57) ABSTRACT

A method of playing a word forming game for two to four players utilizing a game board marked off in a grid pattern. There are a plurality of tiles, equally distributed between the players, having various letters imprinted thereon. Such game board having the word CHANGIT reading left to right disposed on tiles in a center of the game board to begin the game. The goal of the game being to get rid of a persons tiles before the other players get rid of theirs by changing words and forming new words.

11 Claims, 4 Drawing Sheets

WORD FORMING BOARD GAME WITH LETTERED TILES

CROSS REFERENCE TO RELATED APPLICATIONS

This application is closely related to and claims benefit from U.S. Provisional Application Ser. No. 60/650,810 filed Feb. 8, 2005.

FIELD OF THE INVENTION

The present invention relates, in general, to a board game, and, more specifically the present invention relates to a board game which involves words are formed by lettered tiles and in which words are changed and new words are formed.

BACKGROUND OF THE INVENTION

There are quite a variety of board games that were available in today's market. One only has to visit a toy store and the shelves lined with all available games. Many of these board games have been primarily devised for the purpose of entertainment, although some have developed for the purpose of developing word skills.

This is an area where there is always a need for more games which can not only be entertaining to the persons playing the game but also help to build language skills as the game is being played.

SUMMARY OF THE INVENTION

Thus, the present invention provides a method of playing a word forming game for two to four players. Such word game utilizes a game board marked off in a grid pattern. There is a plurality of tiles having various letters imprinted thereon. The game is begun by having the word CHANGIT reading left to right disposed on tiles in a center of the game board. The goal of such word game being to get rid of a persons tiles before the other players get rid of theirs. The method comprises the steps of deciding who plays first by drawing a tile wherein a lowest tile drawn is a first person to play, lowest tile being the lowest letter in the alphabet from the tiles that were drawn. The next step involves distributing the tiles evenly among the players. The game is begun by the first player by changing the word CHANGIT, which is disposed in the center of the game board, to form a different word by at least one of adding letters and removing letters from the word CHANGIT. After changing the word CHANGIT the same player forms a completely new word. This is followed by placing such completely new word anywhere on such game board providing that such word reads left to right. The next player to play as decided by order of such original drawing of tiles changes an existing word that is already on the game board to a different word by at least one of adding letters and removing letters remembering that at least one of the letters of the original word that is being changed must remain in it's original position. The same player then forms a completely new word and places such new word anywhere on the game board providing that such word reads left to right and making sure that there is a space between such new word and any existing word on the board. The game continues by the next player, if there are three players or the first player if there are only two players, repeating the previous steps of changing an existing word and adding a new word. This continues as such players in the game rotate turns until the game is decided and a winner is declared when a player has used up all of his tiles.

OBJECTS OF THE INVENTION

It is, therefore, one of the primary objects of the present invention to provide a word game that utilizes a game board.

Another object of the present invention is to provide a word game in which players change a word that is presently on the board and then add a new word to the board.

Still another object of the present invention is to provide a word game in which the goal of the game is for a player to use up all of his tiles before the other players do.

Yet another object of the present invention is to provide a word game in which there are 84 tiles distributed evenly between the players.

Another object of the present invention is to provide a word game that can be played by two to four players.

These and various other objects and advantages of this invention will become apparent after a full reading of the following detailed description, particularly, when read in conjunction with the attached drawings as described below and the appended claims.

Figure 1:
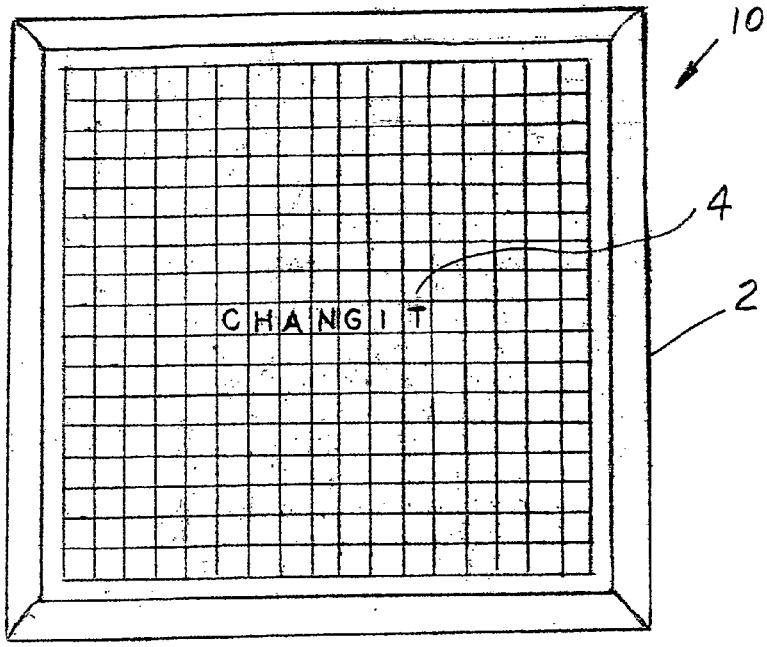
FIG. 1 is a plan view of the present invention showing the game board with the word CHANGIT disposed in the center of the game board.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

The present invention provides an apparatus, generally designated 10, for providing a game board 2 in which letters 4 are disposed thereon. The goal of the game is to get rid of your tiles before the other player or players get rid of theirs. The game is for 2 to 4 players.

There are 84 tiles to be used by the players. This set of tiles is comprised by having two complete sets of a full alphabet along with four extra letters for the vowels, A, E, I, O and U and the letters D, R, and N. There are also additional tiles that are needed to form the word CHANGIT 4 which is placed in the center of the game board when the game begins.

The idea of CHANGIT is to get rid of your tiles before your opponent(s) get rid of theirs. When there are only two players each player gets 42 tiles. That would be half of the tiles that are available. When there are three or four players the tiles are divided equally between the players.

Figure 2:
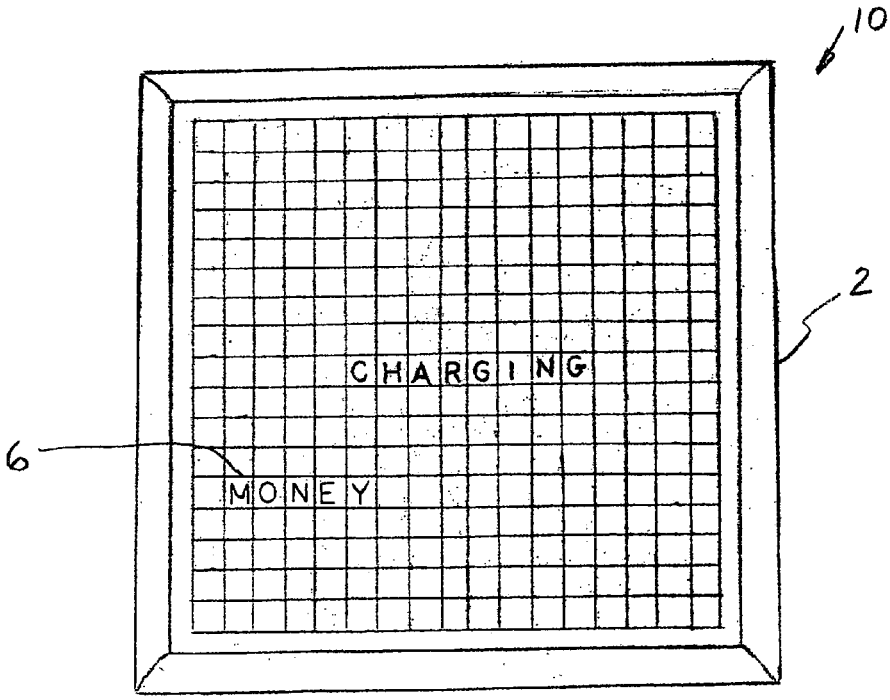
FIG. 2 is a plan view of the present invention showing the board, as an example, after the first player has played.

Players decide who goes first by drawing a tile; the lowest tile goes first. Lowest being the lowest letter in the alphabet from those drawn. The first player begins the game by changing the word CHANGIT. This could be done by removing the "ngit" and adding "rging" to make the word charging. Or the word CHANGIT could be changed to another word in a similar manner. Then the same player forms a completely new word 6. This word can be placed anywhere on the game board but the new word must read from left to right. This play is evident in FIG. 2.

Figure 3:
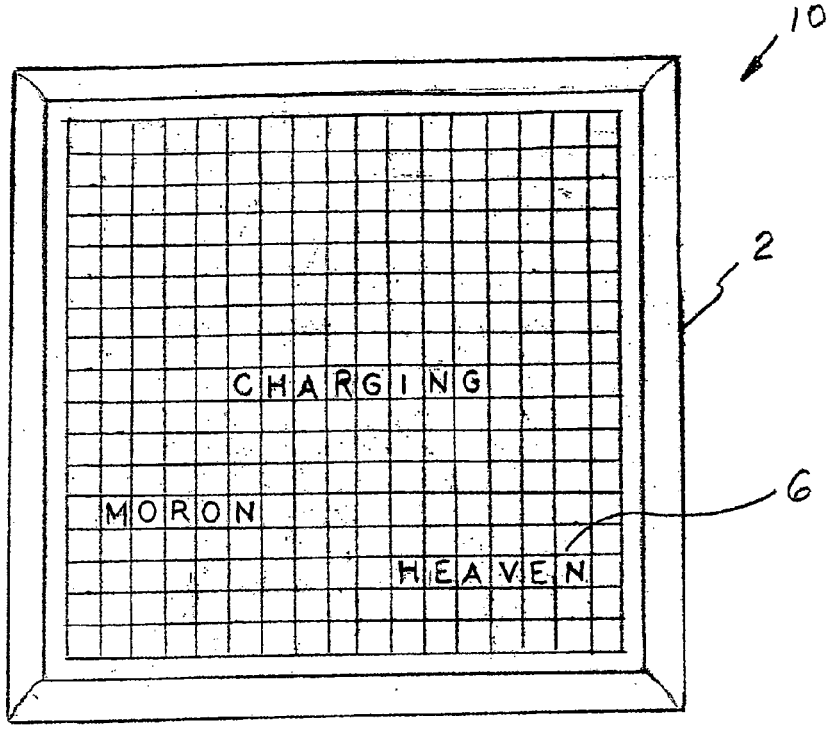
FIG. 3 is a plan view of the present invention showing the game board, as another example, after a second player has played.
Figure 4:
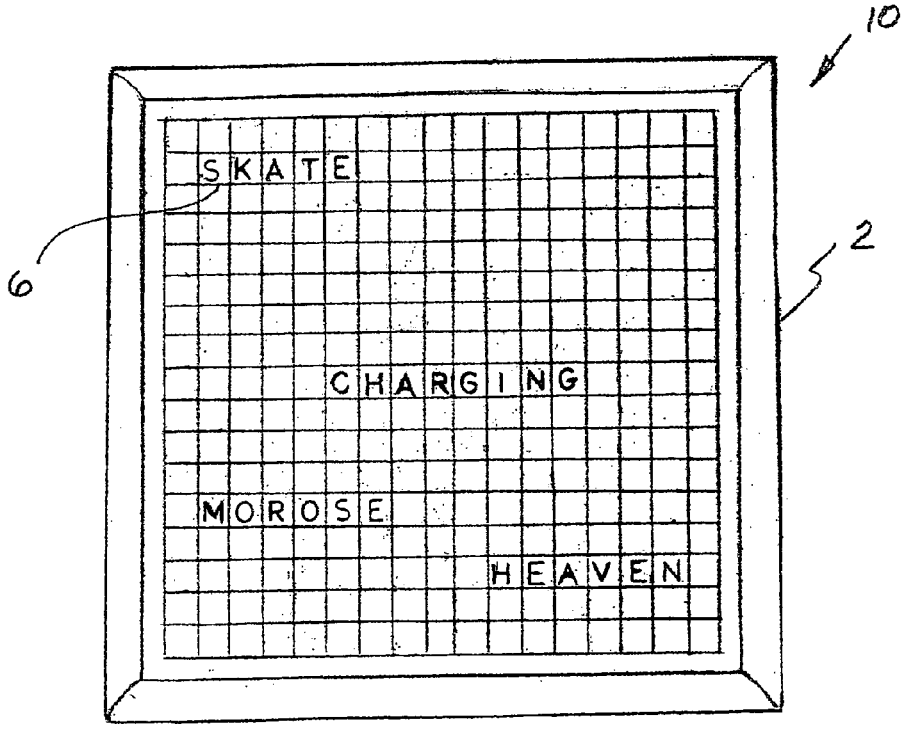
FIG. 4 is a plan view of the present invention showing the game board, as another example, after the next play has been made.
Figure 5A:
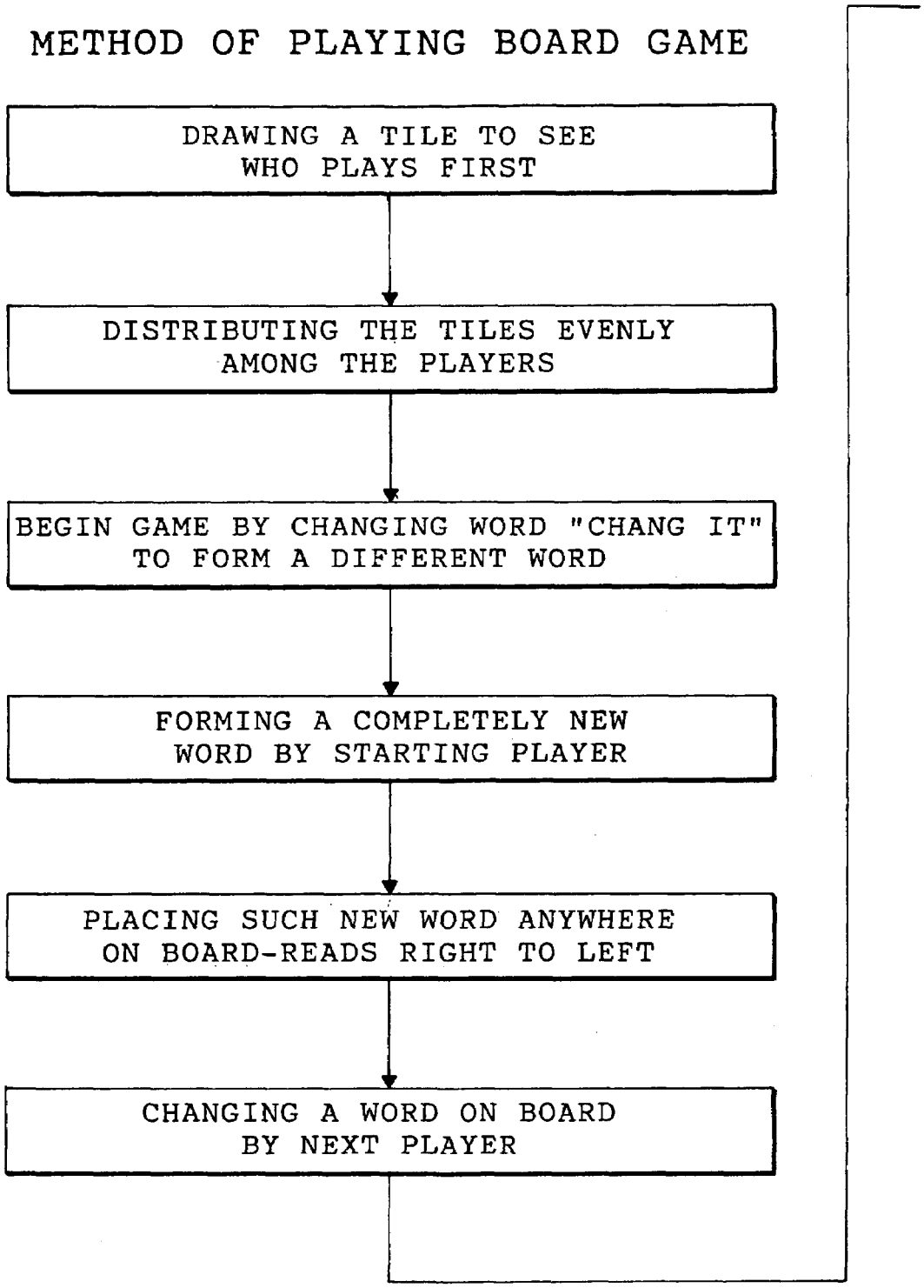
FIG. 5*a* is block diagram showing the method of playing a board game.
Figure 5B:
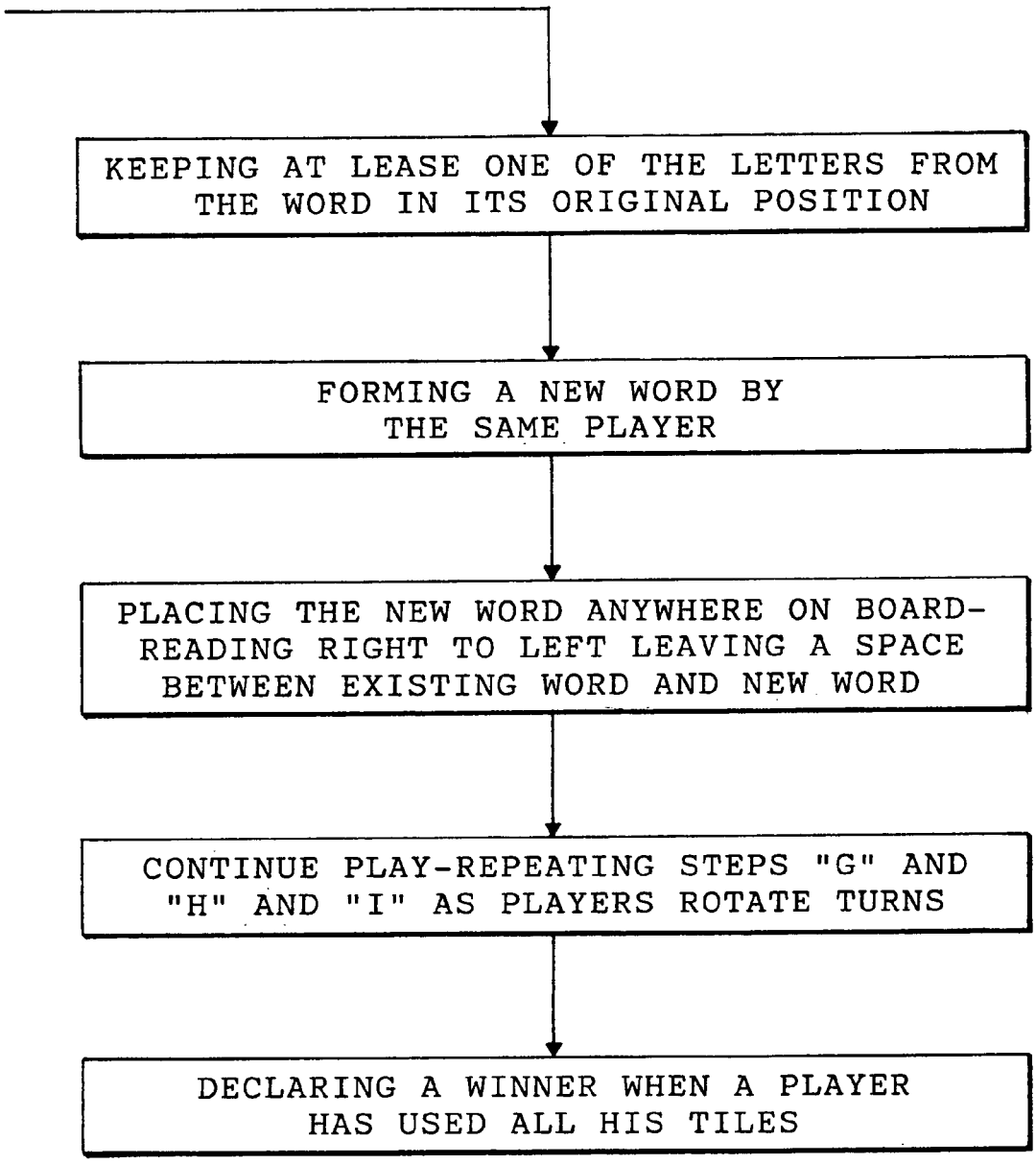
FIG. 5*b* is a block diagram as a continuation of FIG. 5*a* showing the method of playing a board game.

The next player, according to the original drawing, can now change either word that is on the board and form a different word, that is the new word that was added or the word that was originally "Changit". When making the changes in the words already there at least one letter must stay in its original position. After changing a word to form a different word, the player then forms a completely new word. This new word 6 can be placed anywhere on the board but again remembering that the word must read from left to right on the game board. Further, there must be a space between any existing word and the new word. Also, there must be a space between a word on the board and any word which a player is trying to change. An example of such second move is seen in FIG. 3. Further, FIG. 4 shows an example of the board as it would look after the third move whether it is by the first player if only two are playing or by the third player.

If there are three or four players then the other player(s) take their turn, in order by the draw, by changing an existing word to a different word and then adding a new word. After the last player has played then the first player takes his (her) turn and this continues and the players rotate turns following the order defined by the tile draw. This continues until a player wins by using up all of his tiles.

As stated previously there must be a space between words when adding a new word or in changing an existing word. The letter S may not be added to form a new word, although a letter S can be used as part of a new word that is being added. The new word can be a plural but a player may not change a word by simply making it plural by adding the letter S. The letters A and I can each be used as a word in order to use up a persons tiles so as to finish a game, since again the idea is get rid of all of a persons tiles to win the game.

A word can be changed without adding any tiles to the word by removing tiles as long as one of the original letters remains in its original position.

An alternate embodiment of the invention provides that all words must end in a consonant. In this embodiment a player cannot end the game by using a letter A or I as in the previous version otherwise all of the rules are basically the same as described above.

In yet another embodiment of the invention, the object is to get all of the opponents tiles. This version lends itself for two players but does not work well for three or four.

Still another embodiment provides that a player has to change any word which the opponent has made.

Another embodiment provides that only 3, 4 or 5 letter words are used. Thus, if a player changes a three letter word the player must make it a four or five letter word. If a four letter word is created then the player must form either a five letter word or a three letter word. If a player creates a five letter word then it must be changed to a three or four letter word.

The tiles may simply be placed on the board keeping them in the squares provided by being careful not to bump the board so as inadvertently moving the tiles. In another embodiment of the invention the game board and the tiles are magnetized so as to keep the tiles in place and thereby eliminate any problem with an accidental disturbance of the tiles on the game board.

While a presently preferred embodiment and alternate embodiments of the present invention has been described in detail above, it should be understood that various other adaptations and/or modifications of the invention can be made by those persons who are particularly skilled in the art without departing from either the spirit of the invention or the scope of the appended claims.

We claim:

1. A method of playing a word forming game for two to four players utilizing a game board marked off in a grid pattern, a plurality of tiles having various letters imprinted thereon, and having the word CHANGIT reading left to right disposed on tiles in a center of said game board in order to start said game, with the goal of such word game being to get rid of a persons tiles before the other players get rid of theirs, said method comprising the steps of:

(a) deciding who plays first by drawing a tile wherein a lowest tile drawn is a first person to play, lowest tile being the lowest letter in the alphabet from the tiles drawn;

(b) distributing the tiles evenly among the players;

(c) beginning the game by changing the word CHANGIT, which is disposed in a center of said game board, to form a different word by at least one of adding letters and removing letters;

(d) forming a completely new word by said same player that started said game;

(e) placing such completely new word anywhere on such game board providing that such word reads left to right;

(f) changing a word already on said game board, by such next player to play by order of such original drawing of tiles, to a different word by at least one of adding letters and removing letters;

(g) keeping at least one of the letters of said word that is being changed in it's original position;

(h) forming a completely new word by said same player;

(i) placing said new word anywhere on said game board providing that such word reads left to right and making sure that there is a space between such new word and any existing word on said board;

(j) playing continues as described in steps (e), (f) and (g) as such players in the game rotate turns; and (k) declaring a winner when a player has used up all of his tiles.

2. The method, according to claim 1, wherein after step (i) said method further includes the step of repeating steps (e), (f) and (g) by a next player when there are three players in said game.

3. The method, according to claim 2, wherein after repeating step (i) when there are three players in said game said method further includes the step of repeating steps (e), (f) and (g) by a next player when there are four players in said game.

4. The method, according to claim 1, wherein said method further includes the step of using letters A and I as a word in order to finish a game by using all of a players tiles.

5. The method, according to claim 1, wherein said method further includes providing a variation wherein all words must be formed in which such words end in consonants.

6. The method, according to claim 1, wherein said plurality of tiles are eighty four.

7. The method, according to claim 6, wherein said plurality of tiles includes two complete sets of letters of the alphabet.

8. The method, according to claim 6, wherein said plurality of tiles includes four additional tiles of each vowel and each of consonants D, R and N.

9. The method, according to claim 1, wherein said method further includes the step of changing a word to form a new word by simply deleting letters in an existing word provided at least one of such original letters remains in it's original position.

10. The method, according to claim 1, wherein said method further includes the step of using only one of three, four and five letter words in at least one of forming a new word and changing an existing word.

11. The method, according to claim 1, wherein said method further includes the step of providing that a player has to change any word which an opponent has made.

* * * * *